United States Patent [19]

Jones, Jr.

[11] 4,209,147

[45] Jun. 24, 1980

[54] STEERING AND STABILIZATION APPARATUS FOR AERIAL MISSILE

[76] Inventor: Allen Jones, Jr., 5028 Lauderdale Ave., Virginia Beach, Va. 23455

[21] Appl. No.: 4,719

[22] Filed: Jan. 19, 1979

Related U.S. Application Data

[60] Division of Ser. No. 822,227, Aug. 5, 1977, Pat. No. 4,135,687, which is a continuation-in-part of Ser. No. 661,626, Feb. 26, 1976, Pat. No. 4,040,373, which is a continuation-in-part of Ser. No. 579,896, May 22, 1975, abandoned, which is a continuation-in-part of Ser. No. 566,353, Apr. 9, 1975, Pat. No. 3,995,575, which is a continuation-in-part of Ser. No. 279,714, Aug. 10, 1972, Pat. No. 3,881,438.

[51] Int. Cl.[2] ..... F42B 13/32

[52] U.S. Cl. ..... 244/3.28

[58] Field of Search ..... 102/3, 34.1, 37.1, 62, 102/88; 244/3.24, 3.27, 3.28, 3.29

[56] References Cited

U.S. PATENT DOCUMENTS 3,415,467 12/1968 Barringer ..... 244/3.29

FOREIGN PATENT DOCUMENTS 57093 7/1912 Austria ..... 102/62

*Primary Examiner*—Stephen C. Bentley

[57] ABSTRACT

An aerial missile is provided with a pair of vane members mounted on opposite sides of the body thereof in recesses provided therefor. Each vane member includes a planar elongated mounting section disposed in a recess; each of such vane member mounting sections being rotatable about an axis passing perpendicularly therethrough adjacent an end thereof. Such axes intersect at a point on the longitudinal plane of symmetry of such missile body and outwardly and downwardly diverge therefrom. Such vane member mounting sections are selectively rotatable after deployment from sheltered positions within such recesses to an operating position about the axis passing through each into and out of alignment with the flowstream moving rearwardly alongside the body of such missile as the same moves forwardly through the air to concurrently serve steering and rolling functions or to serve a pitching function.

3 Claims, 5 Drawing Figures

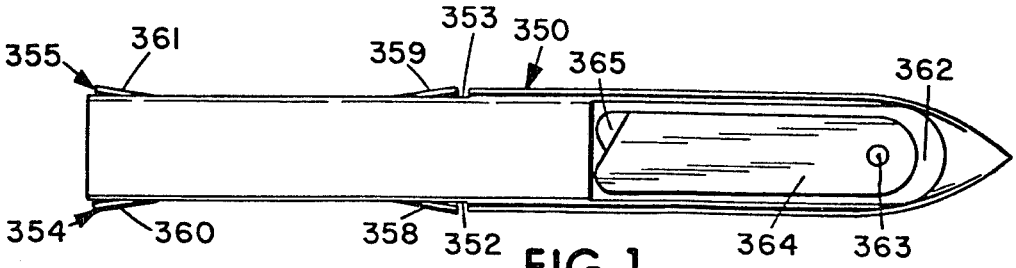
FIG. 1
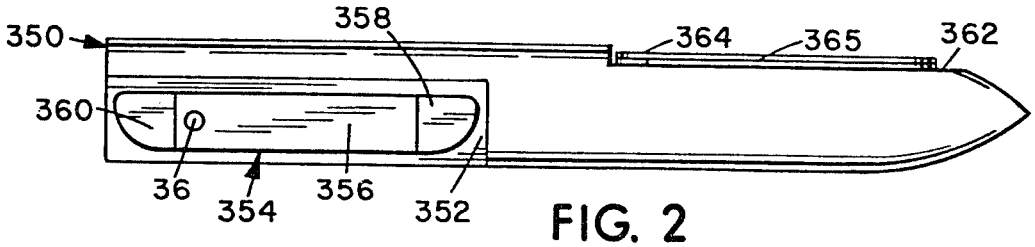
FIG. 2
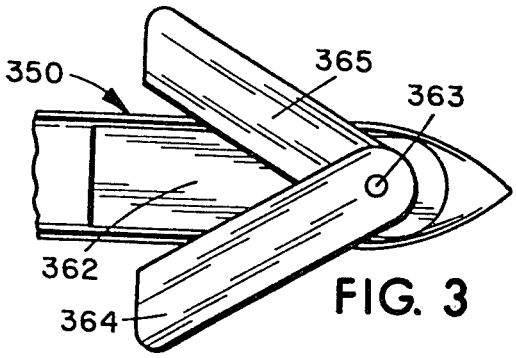
FIG. 3
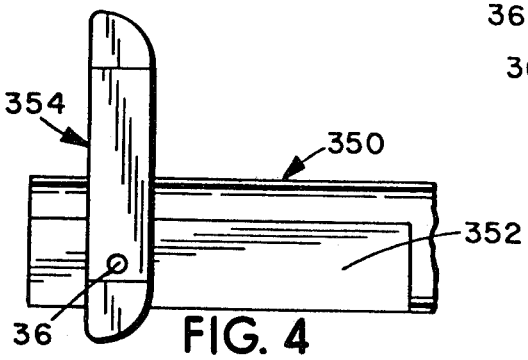
FIG. 4
FIG. 5
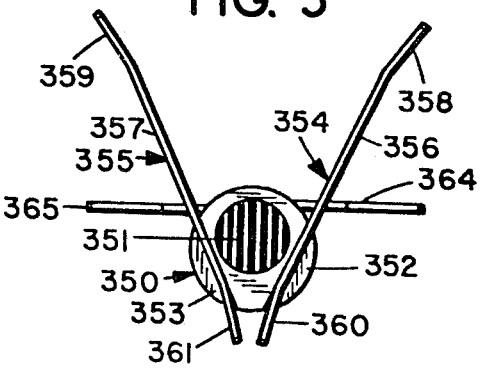

STEERING AND STABILIZATION APPARATUS FOR AERIAL MISSILE

The present application is a division of application Ser. No. 822,227, filed Aug. 5, 1977, to become U.S. Pat. No. 4,135,687 dated Jan. 23, 1979, which is a continuation-in-part of application Ser. No. 661,626, filed Feb. 26, 1976, now U.S. Pat. No. 4,040,373, issued Aug. 9, 1977, which was a continuation-in-part of application Ser. No. 579,896, filed May 22, 1975, now abandoned, which was a continuation-in-part of application Ser. No. 566,353, filed Apr. 9, 1975, now U.S. Pat. No. 3,995,575, issued Dec. 7, 1976, which in turn was a continuation-in-part of application Ser. No. 279,714, filed Aug. 10, 1972, now U.S. Pat. No. 3,881,438, issued May 6, 1975.

The present invention relates to steering and stabilization apparatus for aerial missiles.

Heretofore, aerial missiles have been provided with vertical and horizontal surfaces extending outwardly from the body thereof operable as or carrying movable control surfaces which serve steering, rolling, and pitching functions. While such prior art devices are adequate for the attainment of the contemplated objectives thereof, it is nevertheless considered that new and novel control means for such aerial missiles capable of providing advantages not heretofore obtainable are desirable. The present invention, accordingly, is drawn to the provision of an aerial missile carrying improved steering and stabilization apparatus operable to provide pitching functions therefor, as well as to coordinate turning and concurrent rolling functions thereof for facilitating stable steering maneuvers.

Accordingly, it is an object of the present invention to provide a novel improved steering and stabilization apparatus for an aerial missile.

Another object of the instant invention is the provision of an aerial missile with improved steering, stabilization, and roll control apparatus.

According to the present invention, the foregoing and other objects are attained by providing a pair of vane members rotatably mounted on opposite sides of the body of an aerial missile. Such vane members are mounted in recesses formed in the sides of the body of such aerial missile to occupy sheltered positions in which they lie completely within the overall cross-sectional outline of the body of such aerial missile, permitting the same to be stored in a launch tube carried by a ship or an aircraft having a tubular interior similar in outline, taken in cross-section, to the overall cross-sectional outline of the body of such aerial missile. Each of such aerial missile body recesses includes a planar surface which operationally extends from a line adjacent the bottom of such aerial missile upwardly towards a line operationally extending along a side of such aerial missile somewhat above the mid-height of the sides of such aerial missile. Each of such planar recess surfaces are operationally sloped at a similar predetermined angle from the vertical and are upwardly diverging; the spacing between their lower edges being about one-fifth of the diameter of the body of such aerial missile. Each of such vane members includes an elongated, rectangularly shaped mounting section having a planar inner surface extending along such planar surface of such aerial missile body recess in which each of such vane members are mounted, and each of such vane members are mounted to rotate about an axis perpendicularly disposed with respect to the adjacent planar recess surface, which is situated substantially adjacent the rearwardmost end of each of such vane member mounting sections. The axes about which such vane members rotate intersect at the longitudinal plane of symmetry of such aerial missile. Each of such vane members also includes forward and rearward short outwardly flared sections.

Such vane members are rotatable about such axes from the sheltered positions thereof to operating positions with the mounting section of each of such vane members operationally diverging more or less upwardly. While in their operating positions, such vane members are counter-rotatable to selectively expose their upper or lower surfaces to the flowstream moving rearwardly alongside the body of the aerial missile carrying the same as it moves forwardly through the air to concurrently serve steering and rolling functions. While in their operating positions, such vane members are rotatable in unison in the same direction forwardly and rearwardly to serve a pitching function and thereby guide such aerial missile carrying the same upwardly or downwardly.

An aerial missile provided with the vane members according to the instant invention may also be provided with airfoil means similarly occupying a sheltered position within the overall cross-sectional outline of such aerial missile also rotatable into an extended operating position.

A more complete appreciation of the invention and many of the attendant advantages thereof will be readily apparent as the same becomes better understood by reference to the following detailed description when considered in connection with the accompanying drawings wherein:

FIG. 1 is a top plan view of an aerial missile employing vane members according to the present invention, as well as airfoils, all disposed in their sheltered positions;

FIG. 2 is a side elevational view of the aerial missile shown in FIG. 1;

FIG. 3 is a partial top plan view of the aerial missile of FIG. 1 with the airfoils thereof in operating positions;

FIG. 4 is a partial side elevational view of the aerial missile of FIG. 1 with the vane members thereof in operating positions; and, FIG. 5 is a rear elevational view of the aerial missile of FIG. 1 with the airfoils and vane members thereof in operating positions.

Referring now more particularly to the drawing, wherein like reference numerals designate identical parts throughout the several views, there is shown an aerial missile, generally designated by the reference numeral 350; the body of missile 350 being generally cylindrical in form although including a rounded forward portion coming substantially to a point. The blunt rearward end of the missile 350 includes the jet exit 351.

Missile 350 is provided on opposite sides of the cylindrical portion of the body thereof with recesses 352, 353 formed therein which commence at a point somewhat rearwardly of the longitudinal midpoint of the length thereof and which extend rearwardly to the blunt rearward end thereof. Each of such recesses 352, 353 includes a substantially planar surface having a longitudinal centerline substantially parallel to the longitudinal centerline of the missile 350, and each of which extends from a line adjacent the bottom of the missile 350 upwardly towards a line operationally extending along a side of such missile 350 somewhat above the mid-height line of the sides of the missile 350. Each of such surfaces are operationally sloped at an angle of about 25° from the vertical and are upwardly diverging. Such surfaces of the recesses 352, 353 have their lower edges spaced apart a distance about equal to one-fifth of the diameter of the cylindrical body portion of the missile 350.

Vane members, generally designated 354, 355 are mounted in the recesses 352, 353, respectively. The vane members 354, 355 include elongated, rectangularly shaped mounting sections 356, 357, respectively, having planar inner surfaces positionable adjacent such planar surfaces of the recesses 352, 353, respectively. Vane members 354, 355 further include forward short outwardly flared sections 358, 359, respectively, as well as rearward short outwardly flared sections 360, 361, respectively.

Each of the vane members 354, 355 are movably mounted on the missile 350 to rotate about an axis perpendicularly disposed with respect to such planar surface of each of the associated recesses 352, 353, respectively, which is situated substantially adjacent the rearwardmost end of mounting sections 356, 357 of such vane members 354, 355, respectively. The axes about which such vane members 354, 355 rotate intersect at the longitudinal plane of symmetry of such missile 350. A drive mechanism such as the drive mechanism 40 shown in FIG. 8 of the drawings of applicant's U.S. Pat. No. 4,040,373, issued Aug. 9, 1977, and fully structurally and functionally described in the specification thereof, may be utilized to move the vane members 354, 355; the shafts 36 and 37 of such drive mechanism 40 being connected to the vane members 354, 355, respectively.

It is to be particularly noted that the outward flare of the forward short sections 358, 359 of the vane members 354, 355, respectively, as well as the outward flare of the rearward short sections 360, 361 of vane members 354, 355, respectively, is very slight, and that when the vane members 354, 355 are disposed within their sheltered positions within the described recesses, with the longitudinal axes of such vane members 354, 355 substantially parallel to the longitudinal axis of missile 350, as shown in FIGS. 1 and 2, no portion of such vane members 354, 355 extends beyond the overall circular cross-sectional outline of such missile 350.

The missile 350 is further provided with another recess 362 formed in the top of the body thereof forwardly of the recesses 352, 353 formed therein; such recess 362 including a substantially planar, substantially operationally horizontally extending surface having a longitudinal centerline substantially parallel to the longitudinal centerline of the missile 350. A rotatable shaft 363 extends upwardly from the interior of the body of missile 350 into such recess 362 on the longitudinal centerline thereof adjacent the forward end thereof. An elongated airfoil 364 which is generally rectangular in planform is connected adjacent one end thereof on the longitudinal centerline thereof to such shaft 363. Another shaft, not illustrated, which is of tubular construction and operationally surrounds shaft 363, is similarly connected to another airfoil 365, which in planform is a mirror image of airfoil 364, and which is adapted to underlie airfoil 364. The lower surface of airfoil 365 is adapted to lie substantially adjacent the described surface of the recess 362, and the lower surface of airfoil 364 is adapted to lie substantially adjacent the upper surface of airfoil 365. The airfoils 364 and 365 are so proportioned that when the same are disposed in their sheltered positions, with their longitudinal centerlines extending parallelly rearwardly and parallel to the longitudinal centerline of missile 350, no portion of such airfoils 364 and 365 extends beyond the overall circular cross-sectional outline of the body of missile 350. Suitable conventional means are provided within the body of missile 350 to counter-rotate the shaft 363 connected to airfoil 364 and the tubular shaft surrounding the same connected to airfoil 365, and no further description thereof is deemed necessary herein.

When the vane members 354, 355, as well as the airfoils 364 and 365, of missile 350 are in their sheltered positions as hereinbefore set forth, and as illustrated in FIGS. 1 and 2, the missile 350 may be placed in a tubular launcher carried by a marine vessel or an aircraft which has a cylindrical inner wall of the same diameter or slightly larger than the cylindrical outer wall of the body of such missile 350. When the missile 350 has been launched, conventional means may be utilized to actuate the drive mechanism 40 for the vane members 354, 355, and to counter-rotate the shafts connected to the airfoils 364 and 365, for extending the vane members 354, 355 into their operating position, as shown in FIGS. 4 and 5, as well as for extending the airfoils 364 and 365 into their operating positions, as shown in FIGS. 3 and 5. In their operating positions, airfoils 364 extends from the right side of missile 350 at about a 60° sweep angle, while airfoil 365 extends from the left side of missile 350 at the same sweep angle. Airfoils 364 and 365 operationally coact to provide sustentation for missile 350. The vane members 354, 355, with the mounting sections 356, 357 thereof operationally diverging more or less upwardly, are operable to provide steering and rolling control for missile 350. More particularly, it will be seen that when the vane members 354, 355 are counter-rotated while in their operating positions, the upper surface of either the mounting section 356 of vane member 354 or the mounting section 357 of vane member 355 will be exposed to the flowstream moving rearwardly alongside the body of missile 350 as the same moves forwardly through the air, while the lower surface of the other of such vane member mounting sections will be similarly exposed to such flowstream. The vane members 354, 355 thereby serve to steer the missile 350 to port or starboard and concurrently serve to properly roll the missile 350 in the direction of turn. Such coordinated steering and heeling functions of the vane members 354, 355 facilitates stable turning maneuvers of the missile 350.

Further, the vane members 354, 355, while in their operating positions, are operable to provide pitch control for the missile 350. Both of such vane members 354, 355 may be concurrently rotated somewhat forwardly to guide the missile 350 upwardly, and may be concurrently rotated somewhat rearwardly to guide the missile 350 downwardly.

It will be noted that the forward short outwardly flared sections 358, 359 of vane members 354, 355, respectively, as well as the rearward short outwardly flared sections 360, 361 of the vane members 354, 355, respectively, augment the effect of operational movements of the mounting sections 356, 357 of vane members 354, 355, respectively.

Obviously, many modifications and variations of the present invention are possible in the light of the foregoing teachings. It is therefore to be understood that within the scope of the appended claims the invention may be practiced otherwise than a specifically described.

What is claimed is:

1. An earlier missile, comprising:

an elongated body;

a pair of elongated vane members carried by said body, each of said vane members having an elongated planar mounting section operationally projecting substantially upwardly away from said body;

mounting means mounting the first of said vane member mounting sections on said body for rotation about an axis extending through said first vane member mounting section perpendicularly thereto adjacent an end thereof and mounting means mounting the second of said vane member mounting sections on said body for rotation about another axis extending through said second vane member mounting section perpendicularly thereto adjacent an end thereof;

wherein recesses are provided on opposite sides of said body, and wherein each of said vane member mounting sections is mounted within one of said recesses, said vane members being rotatable between an operating position thereof and a sheltered position thereof within said recesses wherein no portion of said vane members projects beyond the overall cross-sectional outline of said body of said missile;

said axes intersecting at a point on the longitudinal plane of symmetry of said body and outwardly and downwardly diverging from said point of intersection thereof, each of said vane member mounting sections being rotatable about said axis extending therethrough and thereby operationally movable into and out of alignment with the flowstream moving rearwardly alongside said body when said missile is moving forwardly through the air to concurrently serve steering and rolling functions, as well as to serve pitching functions.

2. The missile of claim 1, wherein said body carries airfoil means providing sustentation for said missile.

3. The missile of claim 1, wherein the body is provided with a further recess, and wherein airfoil means occupy a sheltered position within said further recess with no portion thereof projecting beyond the overall cross-sectional outline of said body, said airfoil means being rotatably extendible from said sheltered position thereof to an operating position providing sustentation for said missile.

* * * * *